United States Patent [19]

Kingsford

[11] Patent Number: 4,832,060

[45] Date of Patent: May 23, 1989

[54] LOOSE MAKE-UP POWDER CONTAINER

[75] Inventor: Ted I. Kingsford, Memphis, Tenn.

[73] Assignee: Plough, Inc., Memphis, Tenn.

[21] Appl. No.: 37,758

[22] Filed: Apr. 13, 1987

[51] Int. Cl.[4] ..... A45D 33/00

[52] U.S. Cl. ..... 132/293; 132/313

[58] Field of Search ..... 132/82 R, 82 A, 82 B, 132/82 C, 82 G, 79 A, DIG. 3; 401/126, 127

[56] References Cited

U.S. PATENT DOCUMENTS 478,358 7/1892 Payne ..... 132/82 R 4,446,879 5/1984 Gueret ..... 132/82 R 4,605,022 8/1986 Gueret ..... 132/82 R

*Primary Examiner*—John Weiss

*Assistant Examiner*—Cary E. Stone

*Attorney, Agent, or Firm*—Gerald S. Rosen; Thomas D. Hoffman; Stephen I. Miller

[57] ABSTRACT

A loose make-up powder container with a brush inserted into a powder reservoir a short distance but not far enough to reach the powder therein. The brush is loaded by inserting the container, then righting it. The amount of powder loaded on the brush is a function of the area of the brush extending into the reservoir.

9 Claims, 4 Drawing Sheets

FIG. 2
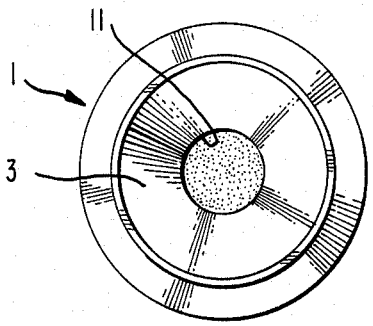
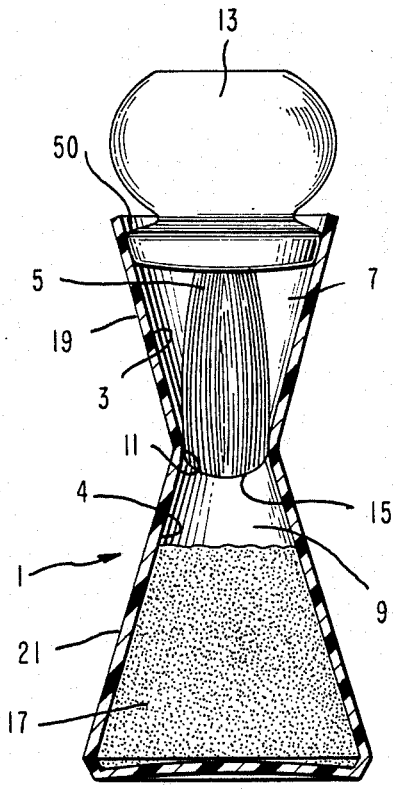
FIG. 1
FIG. 3
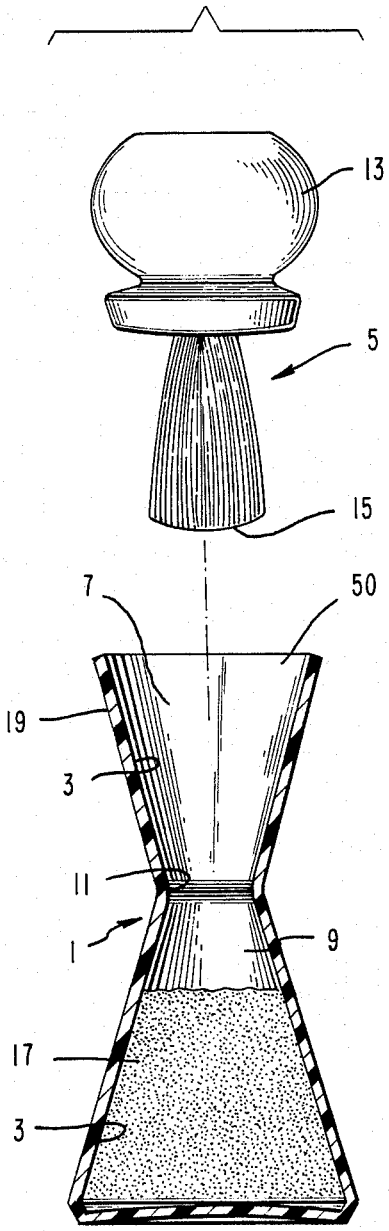

FIG. 5
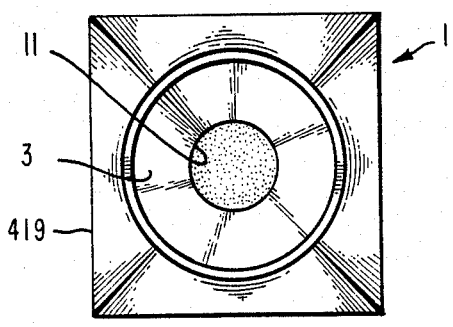
FIG. 7
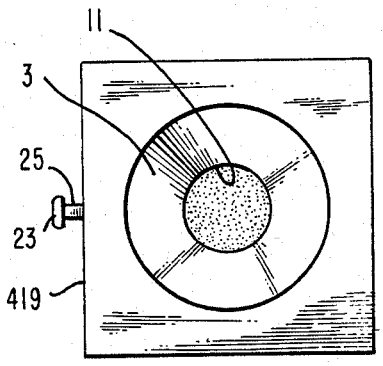
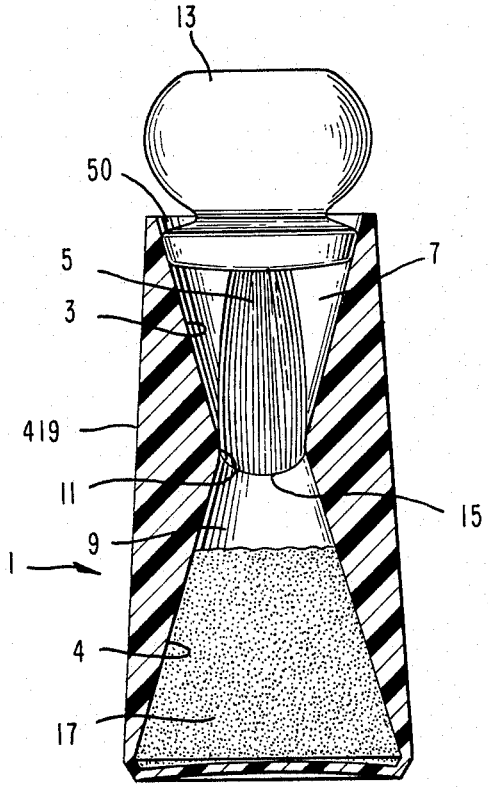
FIG. 4
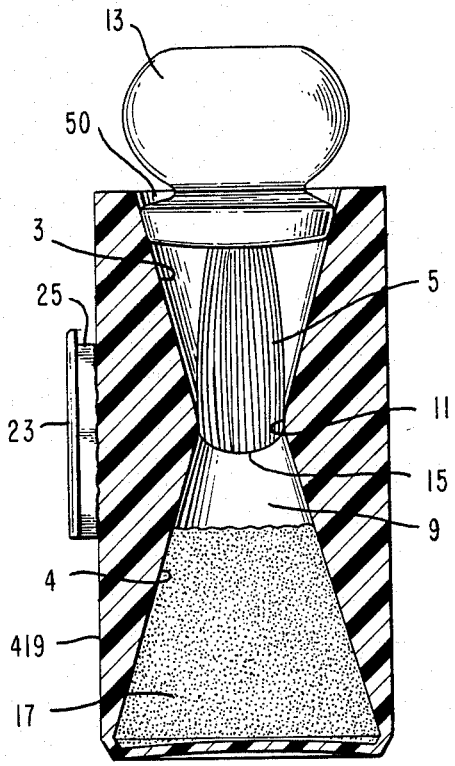
FIG. 6

FIG. 9
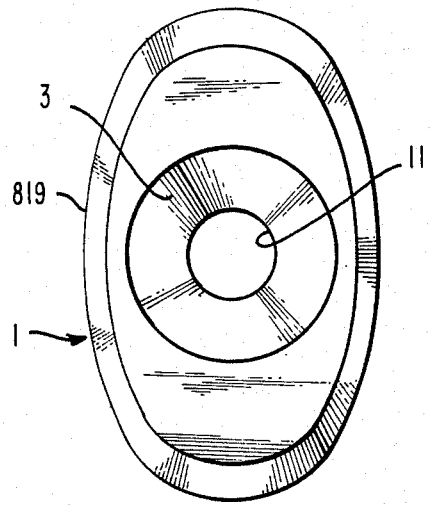
FIG. 11
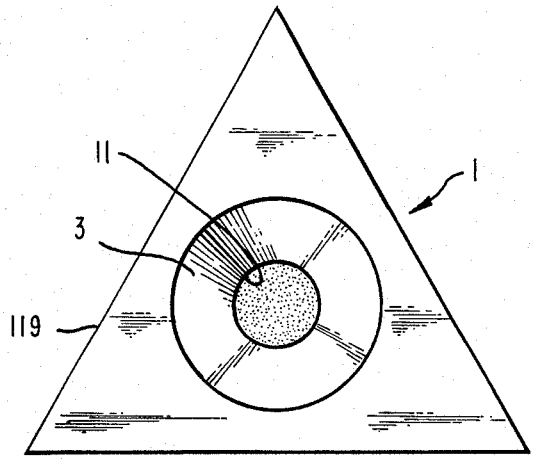
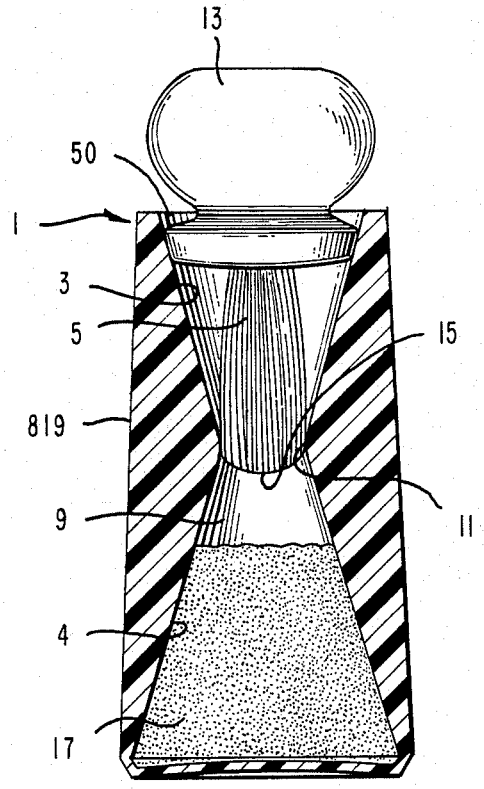
FIG. 8
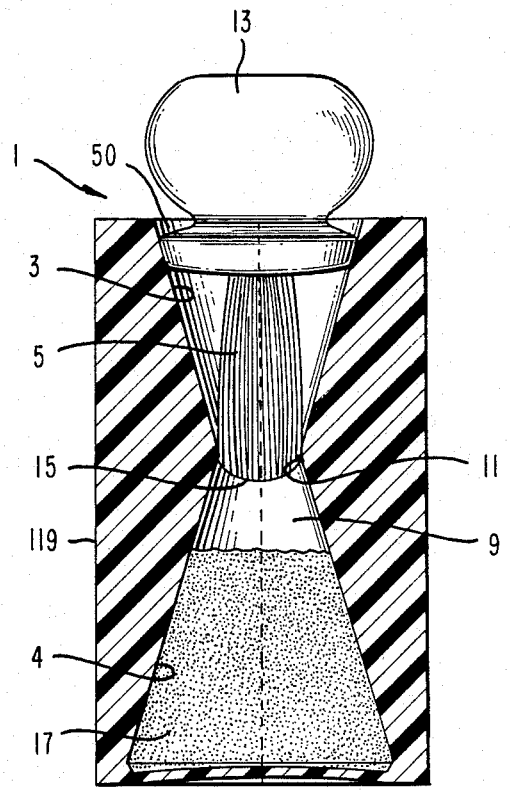
FIG. 10

FIG. 13
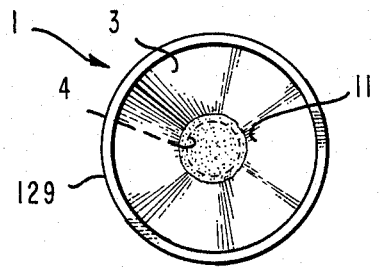
FIG. 16
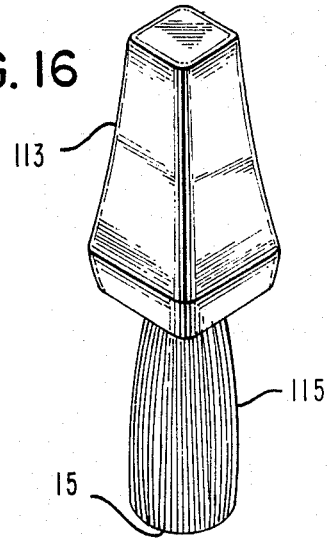
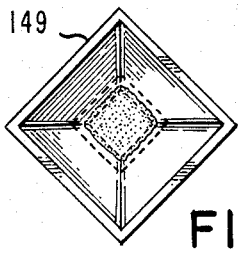
FIG. 15
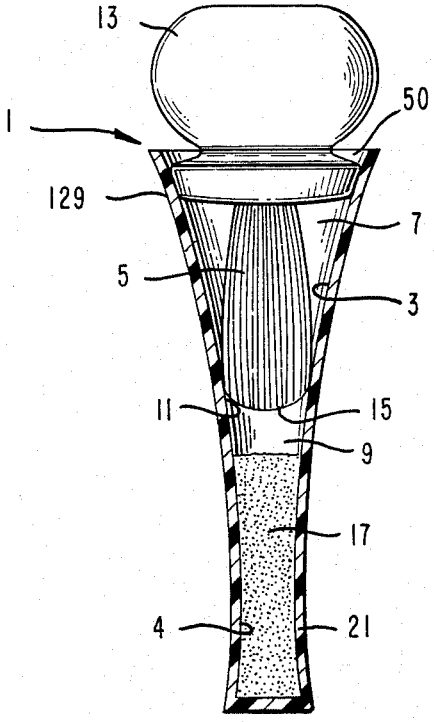
FIG. 12
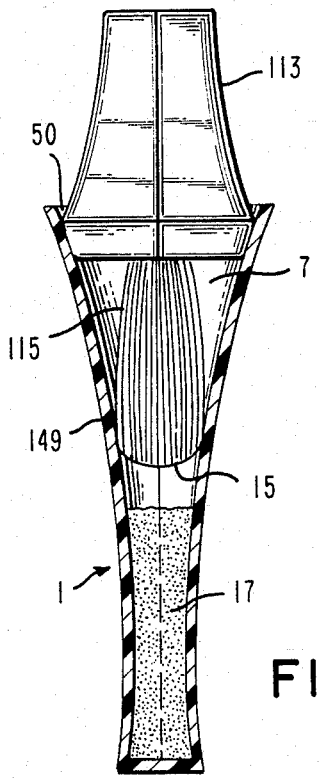
FIG. 14

LOOSE MAKE-UP POWDER CONTAINER

BACKGROUND OF THE INVENTION

This invention relates to a container for holding non-compacted loose make-up powder in a substantially fluid state and for dispensing a controlled amount of such powder via a brush attached to a closure cap which fits into and seals the container.

Typically, loose powder is contained in a receptacle comprising a closing lid, a casing and a small applicator powder puff accommodated between the lid and the casing. Such a receptacle has several drawbacks, for example, when opened, powder can be accidently blown out or dropped out. When the powder is applied by means of a powder puff, uncontrolled amounts are used and substantial dusting occurs.

Various attempts have been made to overcome these problems with varying degrees of success U.S. Pat. No. 4,446,879 discloses a device with two interconnecting compartments, one of which contains a brush in a triangular duct. Powder is applied to the brush by inverting the device, then righting it. The amount of powder which goes on the brush is limited and when the brush is removed, the powder does not "snap off". The first compartment has a filling hole closed by a substantially non-removable plug and the second compartment has a duct in it to receive an applicator or a stopper. Although the device may reduce dusting and loss of powder upon opening, it is of a relatively complicated structure and permits the brush bristles to rest on the floor thereof, thus compacting any powder underneath it in the loading zone.

U.S. Pat. No. 4,605,022 disclosed a make-up powder compact similar to the one disclosed in U.S. Pat. No. 4,446,879 and which operates similarly. However, the structure is more complicated. One of the main advantages of the reference device is that it has a brush with an outwardly flaring tuft of hairs to carry the powder, which tuft can be radially inwardly squeezed by means of an axially slidable collar before the brush is returned to its duct in the take-up compartment. However, the end of this brush also is adjacent the floor of the take-up compartment, and if any powder remains therein after loading, the brush will compact the powder beneath it when returned to the unit after use.

U.S. Pat. No. 342,206 discloses a powder puff on a handle with a spring attached to the cover of a powder box. The puff contacts the powder when the handle is pushed down.

U.S. Pat. No. 599,775 discloses a powder box screw-on cover holding a powder puff. The puff rests in the powder.

U.S. Pat. No. 2,124,058 discloses a container for liquid shaving soap having a frustoconical opening. A cover holding a brush places the brush in the frustoconical opening but not in the shaving soap. The brush is contacted by the soap when the container is tilted. The container has a portion above the level of the liquid which holds excess liquid when the container is tilted.

U.S. Pat. No. 1,643,815 discloses a container with an applicator in its cover. Inside the container is a reservoir that is moved toward the applicator by a screw arrangement so the applicator is loaded with cosmetic.

U.S. Pat. No. 3,694,096 discloses a retractable applicator which is pushed into powder in a container, then removed.

U.S. Pat. No. 3,908,675 discloses an eyeshadow receptacle and applicator in which excess powder is removed from the applicator by agitation.

BRIEF DESCRIPTION OF INVENTION

This invention relates to a container for loose make-up powder comprising two internal sectors, i.e. an upper sector and a lower sector, directly connected by an orifice with no intervening walls or other separating structures.

The structure of the container is adapted for receiving a brush held by a closure into the upper sector so that the end of the brush bristles block a horizontal area at which the upper and lower sectors meet, i.e., the connecting orifice, preventing powder from entering the upper sector. In some embodiments of this invention, the horizontal area, i.e., line, at which the brush blocks the passage of powder is defined only by the location of the ends of the brush bristles rather than by such location due to the structure of the internal walls of the container. This location will hereafter be designated "connecting orifice".

The container of this invention permits the user to meter the amount of powder collected on the ends of the brush bristles. The specific amount collected is a function of the area of the end of the brush facing the powder.

The lower sector is a reservoir for the loose make-up powder, or any other personal care loose powder such as baby powder, body powder or medicated powder. Any of the enumerated powders as well as others conventional in the art are suitable for use in this invention. For convenience, the invention will be described using loose make-up powder.

The upper sector has a second (top) orifice at the upper portion thereof for receiving loose powder as it is loaded into the reservoir via the upper sector and the connecting orifice. The top orifice of the upper sector also receives a closure cap with a brush having bristles depending downward therefrom with a slight flare.

The inside walls of the container defining the upper and lower sectors can be of a variety of geometric shapes. The top orifice of the upper sector must have a cross-section which is larger than the connecting orifice and larger than the cross-section of the applicator brush at its largest cross-section. The cross-section of the connecting orifice is at most, equal to the largest cross-section of the applicator brush but preferably is smaller so that the brush, upon insertion therein is compressed to produce a tight fit in the orifice.

The inside walls of the upper sector extend continuously with a smooth surface from the top orifice to the connecting orifice and to the reservoir. The inside walls of the reservoir are a continuation of the inside walls of the connecting orifice and the upper sector and extend from the connecting orifice to the bottom or floor of the reservoir. In some embodiments, the inside walls continue with no discernable break at the connecting orifice.

The inside geometric configuration of the upper sector can be any convenient shape so long as the too orifice has a larger cross-section than the brush intended to be inserted therein. Frustoconical or rectangular are examples of suitable configurations. The geometric configuration of the inside walls of the reservoir can be any convenient shape, for example, rectangular, cylindrical, frustoconical and the like. The preferred shape of the upper and lower sectors are opposing frustoconical with the connecting orifice at the area where the apices meet.

The bristles of the brush are sufficiently long so the terminal ends reach into the top of the lower sector a very small distance, for example, less than $\frac{1}{8}$ inch, depending on the configuration and area of the brush end. For example, if the terminal end configuration is rounded as in a conventional shaving brush, then extension of about $\frac{1}{8}$ inch into the reservoir is normal. If the terminal end configuration is flat, then less than $\frac{1}{8}$ inch is extended into the reservoir. Thus, the area available to be loaded with powder can be controlled by the configuration of the brush end.

A function of the inside walls of the upper sector of the container is to direct the brush toward the narrowed opening of the connecting orifice without bending the bristles back upon themselves. The walls also compress the bristles to a configuration which allows the ends of the brush to enter into or form the connecting orifice and block it so no loose powder can enter the upper sector. The configuration of the brush can be any convenient shape which fits into the top orifice, e.g. round, oval or rectangular. The area of the brush end when compressed into the connecting orifice determines how much powder can be loaded thereon. This area is predetermined at the time of manufacture.

The function of the inside walls of the lower sector, i.e. the powder reservoir is to direct the powder flow toward the brush when the container is inverted.

The amount of powder which is loaded on the brush is controlled by the extent the brush extends into the reservoir, the area of the brush end and the number of times the container is inverted. It is thus possible to closely control the amount of powder applied by the user.

The location of the connecting orifice in relation to the height of the container is not critical, what is critical is the area of the brush end available to be loaded with powder and the length it extends into the reservoir as well as the number of times the container is inverted. The approximate area of the brush end exposed to the powder in the reservoir is, depending on the cross-section of the brush, about 1 to 2 square inches. When the container is inverted the powder is loaded only onto the bristle ends which extend into the reservoir. The brush blocks powder from contacting more bristle area at the connecting orifice, this effectively causes the powder to be metered onto the bristles. Preferably the connecting orifice is approximately midway between the top orifice and the bottom or floor of the container, but this location is not critical to the operation of the device of this invention.

The amount of powder in the reservoir, when loaded, is an amount that does not reach the brush bristles when the brush is fully inserted and the container is upright.

The outside configuration of the container can be any desired shape, e.g. opposing frustoconical, rectangular, oval, triangular, irregular shaped and the like. The inside walls of the upper sector, however, must be shaped so that they cleanly guide the brush bristles into the connecting orifice so only the terminal ends of the brush protrude into the reservoir as already described.

The geometric configuration of the inside walls of the reservoir is optional, however, they should direct the powder onto the ends of the bristles when the container is inverted in order to meter the powder onto the brush. The more times the container is inverted and then righted, the more powder is metered onto the brush. Thus, the inside walls should be smooth. Each user can determine by trial how much powder is suitable and how many time inversion is necessary.

The container can be made of molded plastic, glass, metal or different portions, particularly the outside, can be of a material different than the inside portion, e.g. wood or plastic decorations can be placed on the outside of the container and adhered thereto with glue or other adhesive.

The brush comprises bristles of sufficient softness to be suitable for applying the loose powder from the container onto the skin of the user. The bristles can be natural and/or synthetic. The bristles are attached at one end to the inside of the closure cap. They are attached by conventional means. The bristles hang generally straight downward from the cap and the total brush is of any convenient cross sectional configuration although circular or rectangular configurations are preferred. The brush bristles flare outward slightly at their terminal end.

The cap can be molded plastic, wood or metal. It can fit into the top orifice, have a circumferential ridge which fits over the upper edge of the container which forms the top orifice or can coact with a flange at the top of the container to lock thereon.

DESCRIPTION OF THE DRAWINGS

FIG. 1 is a longitudinal side sectional view of a container of this invention with the closure and brush in place;

FIG. 2 is a top plan view of the container of FIG. 1 with the closure and brush removed;

FIG. 3 is a longitudinal side sectional exploded view of the container of FIG. 1 showing the closure and brush removed;

FIG. 4 is a longitudinal side sectional view of a second embodiment of a container of this invention with the closure and brush in place;

FIG. 5 is a top plan view of the container of FIG. 4 with the closure and brush removed;

FIG. 6 is a longitudinal side sectional view of a third embodiment of a container of this invention with the closure and brush in place;

FIG. 7 is a top plan view of the container of FIG. 6 with the closure and brush removed;

FIG. 8 is a longitudinal side, sectional view of a fourth embodiment of a container of this invention with the closure and brush in place;

FIG. 9 is a top plan view of the container of FIG. 8 with the closure and brush removed;

FIG. 10 is a longitudinal side sectional view of a fifth embodiment of a container of this invention with the closure and brush in place;

FIG. 11 is a top plan view of the container of FIG. 10 with the closure and brush removed.

FIG. 12 is a longitudinal side sectional view of a sixth embodiment of a container of this invention with the closure and brush in place;

FIG. 13 is a top plan view of the container of FIG. 12 with the closure and brush removed;

FIG. 14 is a longitudinal side, sectional view of a seventh embodiment of a container of this invention with the closure and brush in place;

FIG. 15 is a top plan view of the container of FIG. 14 with the closure and brush removed;

FIG. 16 is a perspective view of the brush of FIG. 14;

DETAILED DESCRIPTION OF INVENTION

This invention can best be described with reference to the drawings in which like numerals refer to like structures.

FIGS. 1, 2 and 3 illustrate a preferred embodiment of this invention wherein the inside walls 3 and 4 of the container 1 are frustoconical and the brush 5 is round. The inner walls 3 and 4 are opposing frustoconical in shape and form an upper sector 7 and a lower sector (or powder reservoir) 9 which meet at approximately midway between the top and bottom of the containers to form a connecting orifice 11. A brush 5 is attached to the containers closure cap 13. The brush 5 fits into the connecting orifice 11 which squeezes the bristles at their terminal end 15 into the connecting opening 11 thereby preventing any loose powder 17 from passing into the upper sector 7.

The outer walls 19 and 21 of the upper sector 7 and lower sector 9, respectively, as shown in FIGS. 1 and 3, are parallel to the respective inner walls 3 and 4.

FIGS. 4, 5, 6, 7, 8, 9, 10 and 11 illustrate embodiments of the invention which differ from the one illustrated in FIGS. 1, 2 and 3 only in the outside configuration. Thus FIGS. 4 and 5 illustrate a container 1 in which the outside walls 419 of the container 1 form a rectangular quadrilaterial. The container 1 illustrated in FIGS. 6 and 7 is substantially identical to the embodiment of the invention illustrated in FIGS. 4 and 5 except it includes a handle 23 attached to the outside wall 419 by connecting means 25.

In FIGS. 8 and 9, the outside wall 819 is oval shaped and the remaining elements of the container 1 are as in FIGS. 1–7 inclusive.

In FIGS. 10 and 11, the outside wall 119 is triangular shaped and the remaining elements of the container 1 are as in FIGS. 1–9 inclusive.

FIGS. 12, 13, 14 and 15 illustrate an embodiment of the container 1 in which the reservoir 9 is narrower than the upper sector 7. The outside wall 129 and 149 is also narrower at the bottom than at the top.

FIGS. 14, 15 and 16 illustrate an embodiment of the container 1 in which the inside and outside 149 configuration of the container is quadrilateral. The brush closure or cap 113 and the brush bristles 115 also are quadrilateral.

Each of the embodiments of the container 1 illustrated, are exemplary of typical shapes and configurations which are suitable for use in this invention although other obvious configurations can also be used. All the embodiments of the containers 1 which are suitable for use in this invention have an upper sector 7 which is shaped so that when the brush bristles 5, 115 are inserted therein, they readily enter the upper orifice 50, slide down the inner walls 3 of the upper sector 7 and the bristles 5, 115 are compressed at the connecting orifice 11 so that they completely block the orifice 11 against loose powder 17 leakage. In all the embodiments, the brush bristles terminal ends 15, reach into the reservoir 9 a short, predetermined distance so that one can meter a desired amount of powder 17 thereon when the container 1 is inverted then righted. The brush bristles 5, 115 cannot extend any further than the predetermined distance into the reservoir because the handle 13 of the brush 5, 115 as in the illustrated embodiments is wide enough to be stopped at the top portion of the upper sector 7 and act as a closure or cap.

In operation, the user simply inverts the container one or more times, depending on the quantity of make-up powder desired and the area of brush bristles extending into the reservoir, then rights the container, removes the brush and applies the powder. The reservoir in the container is readily refilled as necessary, by pouring powder into it through the top orifice 50.

What is claimed is:

1. A container for loose make-up powder comprising an upper sector and a lower sector connected by an orifice, wherein the lower sector is a loose powder reservoir and the upper sector has an orifice at the top thereof for receiving a closure cap with brush bristles depending downward therefrom; wherein the upper sector's inner walls are configured so that the brush is insertable therein without substantial deformation of the bristles and the connecting orifice is of a size which permits the brush bristles to enter and block the orifice to prevent powder from passing through; the top orifice, is wide enough to receive and hold the closure cap at a sufficient distance from the connecting orifice to allow the brush bristles to enter the connecting orifice and reach into the reservoir without reaching powder stored in the reservoir.

2. The container of claim 1 wherein the upper sector and lower sector are opposing frustoconical in configuration.

3. The container of claim 1 wherein the outside configuration thereof is of a generally rectangular shape.

4. The container of claim 1 wherein the outside configuration thereof is of a generally triangular shape.

5. The container of claim 1 wherein the outside configuration thereof is of a generally oval shape.

6. The container of claim 1 wherein both inside and outside configurations thereof are of a quadrilateral shape.

7. The container of claim 1 wherein both inside and outside configurations thereof are opposing frustoconical.

8. The container of claim 1 having loose make-up powder in the powder reservoir and wherein the brush in the upper sector extends into the reservoir without reaching the powder therein.

9. A method of cosmetically applying loose make-up powder using a container for said loose make-up powders said container comprising an upper sector and a lower sector connected by an orifice, wherein the lower sector is a loose powder reservoir and the upper sector has an orifice at the top thereof for receiving a closure cap with brush bristles depending downward therefrom; wherein the upper sector's inner walls are configured so that the brush is insertable therein without substantial deformation of the bristles and the connecting orifice is of a size which permits the brush bristles to enter and block the orifice to prevent powder from passing through; the top orifice is wide enough to receive and hold the closure cap at a sufficient distance from the connecting orifice to allow the brush bristles to enter the connecting orifice and reach into the reservoir without reaching powder stored in the reservoir; comprising the steps of loading said powder reservoir of said container with said loose powder placing the closure cap with brush in the upper orifice and connecting orifice of said container to seal the container; inverting the container to meter the desired amount of the powder loaded onto the brush; righting the container; then removing said brush from the container and applying the powder with the brush.

* * * * *